United States Patent [19]

Adair

[11] Patent Number: 4,708,581

[45] Date of Patent: Nov. 24, 1987

[54] METHOD OF POSITIONING A TRANSFER ARM

[75] Inventor: Harold L. Adair, Rockwall, Tex.

[73] Assignee: W-N Apache Corporation, Wichita Falls, Tex.

[21] Appl. No.: 4,205

[22] Filed: Dec. 31, 1986

Related U.S. Application Data

[63] Continuation of Ser. No. 747,351, Jun. 21, 1985, abandoned.

[51] Int. Cl.[4] ..... E21B 19/14

[52] U.S. Cl. ..... 414/786; 91/508; 175/85; 414/22; 414/680; 414/745

[58] Field of Search ..... 414/22, 680, 745, 23, 414/786, 24; 901/22; 91/508, 520; 175/85

[56] References Cited

U.S. PATENT DOCUMENTS

| | | | |
|---|---|---|---|
| 3,177,944 | 4/1965 | Knights | 175/85 X |
| 3,633,771 | 1/1972 | Woolslayer et al. | 414/22 |
| 3,682,259 | 8/1972 | Cintract et al. | 414/22 X |
| 3,700,222 | 10/1972 | Baxter et al. | 269/58 X |
| 4,407,629 | 10/1983 | Willis | 414/745 |
| 4,547,110 | 10/1985 | Davidson | 414/22 |

*Primary Examiner*—Robert J. Spar
*Assistant Examiner*—Janice Krizek
*Attorney, Agent, or Firm*—Willian Brinks Olds Hofer Gilson & Lione, Ltd.

[57] ABSTRACT

A drilling apparatus of the type having a drilling mast and a transfer arm mounted at a first axis adjacent the mast to move between a lower position near ground level and an upper position aligned with the mast is provided with a reaction point anchor fixed with respect to the drilling mast and spaced from the first axis. A fixed length link is pivotably mounted to the transfer arm at a second axis, spaced from the first axis, and a first single stage cylinder is pivotably mounted at one end to the distal end of the link and at the other end to the transfer arm. A second single stage hydraulic cylinder is pivotably mounted at one end to the distal end of the link and at the other end to the reaction point.

5 Claims, 3 Drawing Figures

METHOD OF POSITIONING A TRANSFER ARM

This application is a continuation of application Ser. No. 747,351, filed June 21, 1985, now abandoned.

BACKGROUND OF THE INVENTION

The present invention relates to an improved apparatus for raising and lowering a transfer arm in a drilling apparatus.

U.S. Pat. No. 4,407,629, assigned to the assignee of the present invention, discloses a drilling apparatus with important commercial advantages. The disclosed drilling apparatus uses a pivoted transfer arm which is mounted adjacent to the drilling mast and is used to move down-hole tubulars between a lower position aligned with a pipe rack and an upper position aligned with the drilling axis of the drilling apparatus. Such transfer arms provide important efficiencies in reducing the manpower and the time required to assemble and disassemble drill strings.

Drilling and casing tubulars are customarily stored on pipe racks at a drill site. It is therefore advantageous for the transfer arm to be designed such that it can load and unload tubulars directly to and from such pipe racks with a minimum of vertical movement of the tubulars. For this reason, it is highly desirable to design the transfer arm positioning system such that tubulars can be transferred between racks and the transfer arm at a relatively low level, typically not over 60–68 inches above ground level.

One prior art approach has been to utilize three or four stage hydraulic cylinders to raise and lower the transfer arm. However, such multiple stage cylinders have a number of important disadvantages. First, such cylinders have been found to provide a relatively short life in many applications. Typically, multiple stage cylinders are designed for intermittent in contrast to continuous duty, and the continuous operations which are necessary when making round trips to change bits, fishing tools or the like can pose excessive demands. Moreover, multiple stage cylinders are not well suited to resist side loads of the type that inevitably occur when rolling heavy drill collars into the clamps mounted on the transfer arm. In addition, multiple stage cylinders expose relatively large hydraulic surfaces which can cause problems when exposed to drilling muds that drip off of drilling tubulars as they are transferred between the drill string and the pipe racks.

Multiple stage cylinders also pose control problems. This is because such a cylinder lifts relatively slowly during the first 10° or 20° of upward movement. However, for a given volume of fluid flow, the angular speed of rotation of the transfer arm increases rapidly as the transfer arm nears the vertical position. This makes it difficult to decelerate the transfer arm smoothly as it approaches the upper position.

A second approach to raising and lowering a transfer arm is shown in the above referenced U.S. Pat. No. 4,407,629. This arrangement utilizes a linkage having a single stage hydraulic cylinder and two fixed length links. This approach also suffers from disadvantages related to smooth control of the deceleration and velocity of the transfer arm as it approaches the upper position. The arrangement shown in U.S. Pat. No. 4,407,629 provides a relatively large angle of rotation of the transfer arm for a relatively small extension of the hydraulic cylinder when the transfer arm is near the vertical position. For this reason, precise control over deceleration and velocity of the transfer arm is difficult to achieve.

SUMMARY OF THE INVENTION

The present invention provides an improved lifting arrangement for a transfer arm which utilizes durable hydraulic cylinders, is compact, and provides improved control of the speed and acceleration of the transfer arm.

According to this invention, a drilling apparatus of the type having a drilling mast and a rigid transfer arm mounted on a first axis adjacent to the mast to move between a lower position near ground level and an upper position aligned with the mast is provided with a transfer arm positioning system which comprises a reaction point which is fixed with respect to the mast and is spaced from the first axis. A fixed length link is pivotably mounted to the transfer arm at a second axis, spaced from the first axis, and this link defines a distal end. A first actuator such as a single stage hydraulic cylinder is pivotably mounted at one end to the distal end of the link and at the other end to the transfer arm. A second actuator such as a single stage hydraulic cylinder is pivotably mounted at one end to the distal end of the link and at the other end to the reaction point.

The system of this invention provides important advantages in that it can be implemented with single stage rather than multiple stage cylinders, it is a durable linkage which is well suited to resist side loads and which exposes a relatively small hydraulic surface to contamination. The linkage of this invention is compact and well suited to lower the transfer arm to a point close to and parallel to the ground. The dual actuators provide improved control over the speed and acceleration of the transfer arm as it nears the upper position aligned with the drilling mast. This improved control makes the linkage of this invention well suited for high speed, fully automatic operation of the transfer arm.

The invention itself, together with further objects and attendant advantages, will best be understood by reference to the following detailed description, taken in conjunction with the accompanying drawings.

BRIEF DESCRIPTION OF THE DRAWINGS

In FIG. 1, the transfer arm of the drilling apparatus is shown in its upper position.

DETAILED DESCRIPTION OF THE PRESENTLY PREFERRED EMBODIMENTS

Figure 1:
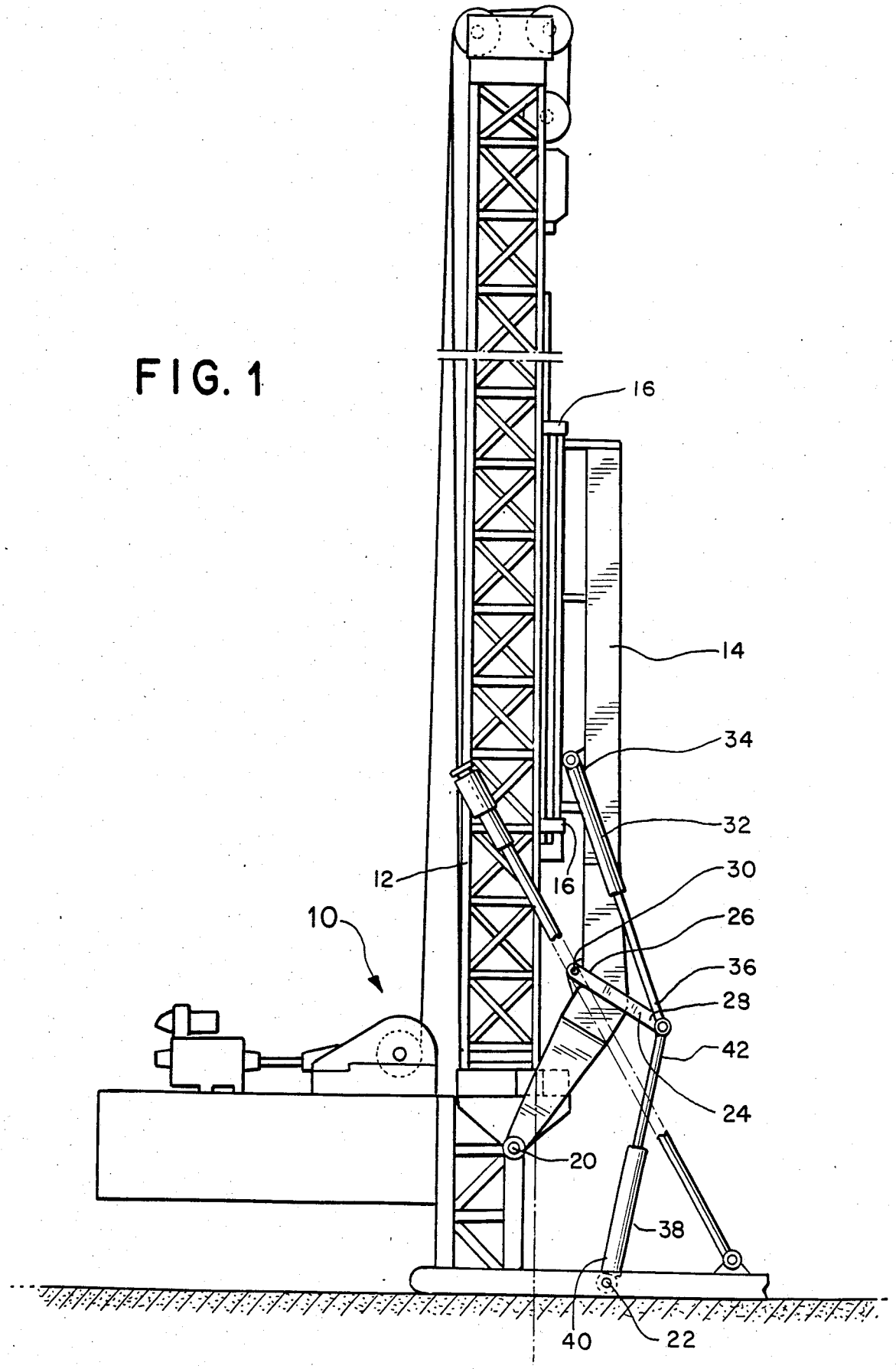
FIG. 1 is a side elevational view of a drilling apparatus which incorporates a presently preferred embodiment of the lifting arrangement of this invention.
Figure 2:
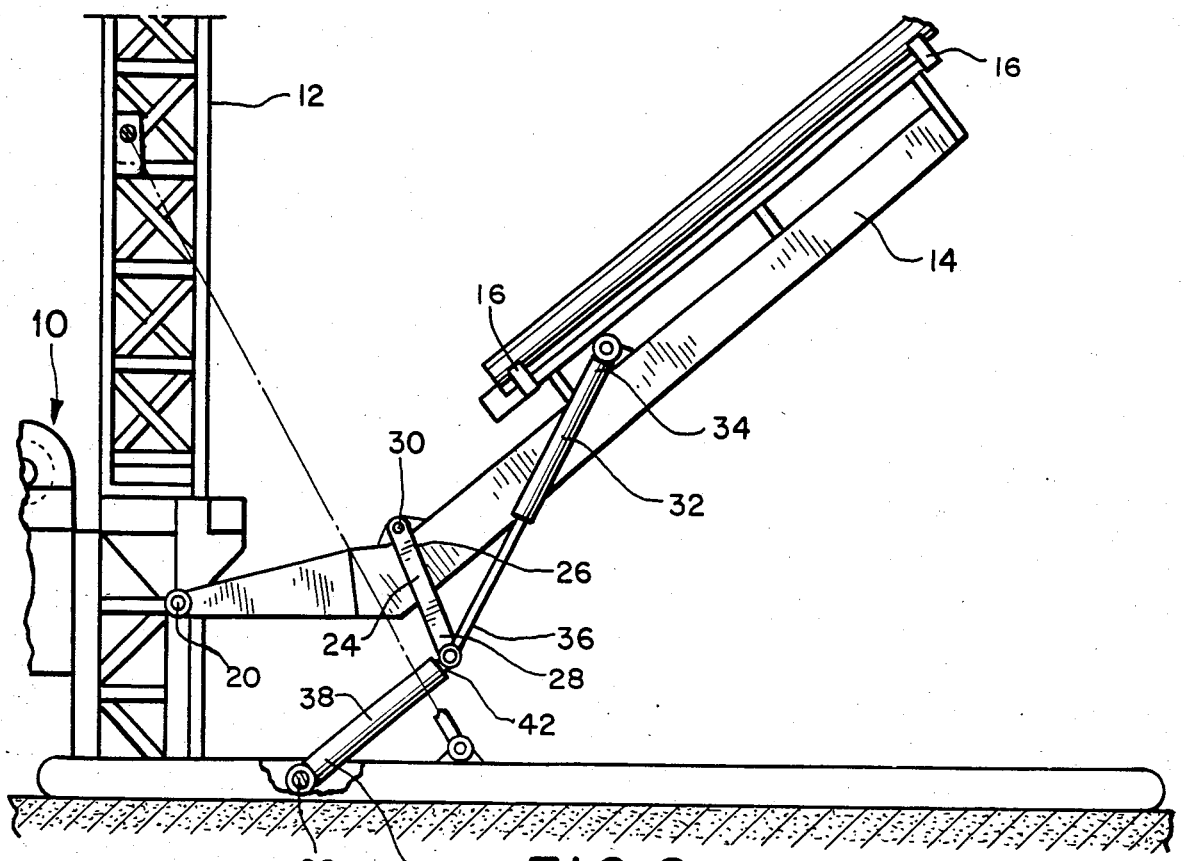
FIG. 2 is a side elevational view of the embodiment of FIG. 1, showing the transfer arm in an intermediate position.
Figure 3:
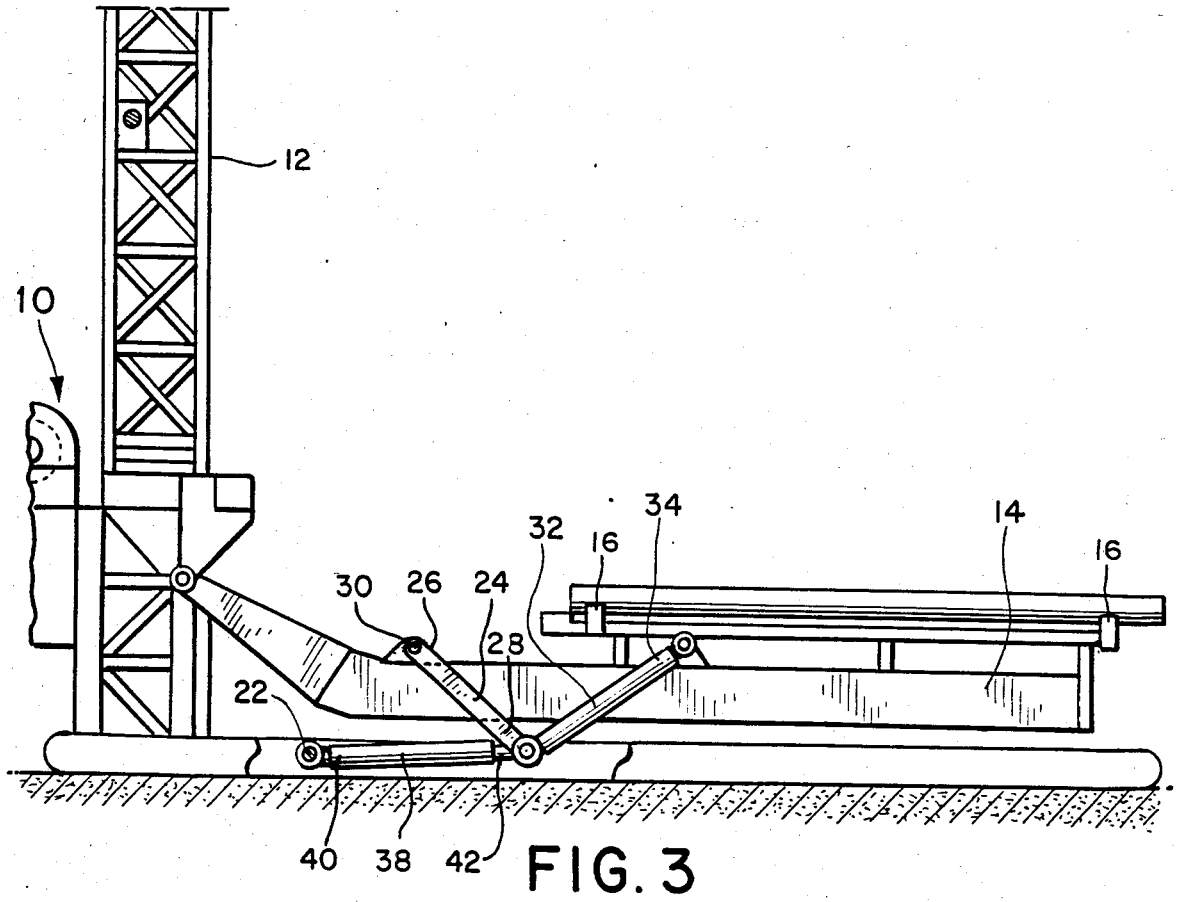
FIG. 3 is a side elevational view of the embodiment of FIG. 1, showing the transfer arm in a lower position.

Turning now to the drawings, FIGS. 1 through 3 show relevant portions of a drilling apparatus 10 which includes a drilling mast 12 and a transfer arm 14. The transfer arm 14 pivots as a rigid unit about a first axis 20 which is fixed with respect to the mast 12. The transfer arm 14 supports two spaced clamps 16 which are used to secure down-hole tubulars to the transfer arm 14 when the transfer arm 14 is used to raise and lower down-hole tubulars between the drill string and a pipe rack.

It should be understood that the positioning system of this invention is suited for a wide variety of drilling devices and transfer arms, and drilling apparatus 10 and the transfer arm 14 have been shown merely to define the environment of this invention. For example, this invention can readily be adapted for use with slant drills in which the mast 12 is not oriented vertically. Similarly the transfer arm 14 can be embodied as a stressed skin, monocoque construction, or a cross braced truss. Because this invention is not directed to any specific structure for the transfer arm 14 or the mast 12, these features will not be disclosed in greater detail here. An example of a suitable transfer arm 14 is described in greater detail in U.S. Pat. No. 4,407,629, which is hereby incorporated by reference for its disclosure of the structure and operation of the transfer arm 14.

According to this invention, a reaction point 22 is rigidly attached to the drilling apparatus 10 at a point spaced from the first axis 20. A fixed length link 24 which defines a first end 26 and a second end 28 is pivotably mounted to the transfer arm 14 about a second axis 30 which is spaced from the first axis 20.

A first actuator 32 such as a conventional single stage hydraulic cylinder defines a first end 34 which is pivotably mounted to the transfer arm 14 and a second end 36 which is pivotably mounted to the second or distal end 28 of the link 24.

A second actuator 38 such as a single stage hydraulic cylinder is provided, and this second actuator 38 defines a first end 40 pivotably mounted to the reaction point 22 and a second end 42 pivotably mounted to the second end 28 of the link 24.

The first and second actuators cooperate with the link 24 to raise and lower the transfer arm 14 in a smooth and easily controlled manner. FIG. 3 shows the transfer arm 14 in the lower position, in which the transfer arm 14 extends parallel to ground level.

In order to raise the transfer arm 14 pressurized hydraulic fluid is supplied to both of the first and second actuators 32, 38. Because the first actuator 32 has an improved mechanical advantage as compared with the second actuator 38 when the transfer arm 14 is in the lower position, the first actuator 32 extends before the second actuator 38, thereby raising the transfer arm 14 to the intermediate position shown in FIG. 2.

As the transfer arm 14 is raised, the first actuator 32 extends fully as shown in FIG. 2, and then the second actuator 38 begins to extend. The second actuator 38 continues to extend until the transfer arm 14 is in the upper position shown in FIG. 1. Even when the transfer arm 14 approaches the upper position of FIG. 1, the angular orientation of the second actuator 38 is such that it provides excellent control over acceleration and velocity of the transfer arm 14. For this reason, precise, high speed, fully automatic control of the position of the transfer arm 14 is possible with the linkage shown in FIGS. 1 through 3.

When it is desired to lower the transfer arm 14 the sequence described above is reversed. If necessary, it may be desirable in some applications to provide separate valves controlling the admission of pressurized hydraulic fluid to the first and second actuators 32, 38 in order to ensure that the actuators 32, 38 extend and retract in the desired sequence. However, for many applications the use of separate valves can be avoided, and the positioning of the actuators 32, 38 can be chosen to ensure that the actuators 32, 38 extend and retract in the desired sequence, automatically as described above.

One important feature of the illustrated embodiment is that the axis 30 is spaced from the axis 20. In the disclosed embodiment the axis 30 is approximately half way between the axis 20 and the end 34 of the actuator 32. This geometry has been found to provide a compact linkage with particularly good control over the speed and acceleration of the transfer arm 14. This is because, when mounted as shown in the drawings, the link 24 raises the upper end 42 of the actuator 38 to an excellent position for control of the final acceleration of the transfer arm 14 as it nears the upper position of FIG. 1.

From the foregoing, it should be apparent that an improved positioning system for a transfer arm has been described which provides excellent control over speed and acceleration, which is durable and well adapted to resist damage from side loading, and which can be integrated readily in a fully automatic high speed control system for the transfer arm.

Of course, it should be understood that a wide range of changes and modifications can be made to the preferred embodiment described above without departing from the scope of this invention. For example, the actuators 32, 38 and the link 24 can be utilized in a single set as shown in the drawings or can be duplicated in two identical sets, one on either side of the transfer arm 14. As discussed above, the structure of the transfer arm itself can be varied widely depending on the particular application, as can the structure of the drilling apparatus and the drilling mast 12. It is therefore intended that the foregoing detailed description be regarded as illustrative rather than limiting, and that it be understood that it is the following claims, including all equivalents, which are intended to define the scope of this invention.

I claim:

1. A method for operating a drilling apparatus of the type having a drilling mast, a rigid transfer arm mounted on a first axis adjacent the mast to move between a lower postion near ground level and an upper position aligned with the mast, and a reaction point which is fixed with respect to the drilling mast and is spaced from the first axis, wherein the method comprises the following steps:

(a) providing a linkage comprising: a fixed length link pivotably mounted to the transfer arm at a second axis, spaced from the first axis, said link defining a distal end; a first hydraulic actuator pivotally mounted at one end to the distal end of the link and at the other end to the transfer arm; and a second hydraulic actuator pivotally mounted at one end to the distal end of the link and at the other end to the reaction point; and (b) supplying pressurized hydraulic fluid to both the first and second hydraulic actuators when the transfer arm is in the lower position in order to extend both the first and second hydraulic actuators to raise the transfer arm to the upper position.

2. The method of claim 1 wherein the upper and lower positions are separated by an arc of about 90 degrees about the first axis.

3. The method of claim 1 wherein each of the hydraulic actuators comprises a respective single stage hydraulic cylinder assembly.

4. A method for operating a drilling apparatus of the type having a drilling mast, a rigid transfer arm mounted to rotate about a first axis adjacent to the mast to move between a lower position near ground level and an upper position aligned with the mast, wherein the upper and lower positions are separated by an arc of about 90 degrees about the first axis, and a reaction point anchor which is fixed with respect to the drilling mast and spaced from the first axis, said method comprising the following steps:

(a) providing a linkage comprising: a fixed length link pivotably mounted to the transfer arm at a second axis, spaced from the first axis, said link defining a distal end; a first single stage hydraulic cylinder assembly pivotally mounted at one end to the distal end of the link and at the other end to the transfer arm; and a second single stage hydraulic cylinder assembly pivotably mounted at one end to the distal end of the link and at the other end to the reaction point anchor; and (b) supplying pressurized hydraulic fluid to both the first and second hydraulic cylinder assemblies when the transfer arm is in the lower position in other to raise the transfer arm to the upper position by extending both of the hydraulic cylinder assemblies.

5. The method of claim 4 wherein the first and second hydraulic cylinder assemblies are dimensioned and arranged such that the first hydraulic cylinder assembly extends before the second hydraulic cylinder assembly when pressurized hydraulic fluid is applied to the first and second hydraulic cylinder assemblies in step (b).

* * * * *

UNITED STATES PATENT AND TRADEMARK OFFICE

CERTIFICATE OF CORRECTION

PATENT NO. : 4,708,581

DATED : Nov. 24, 1987

INVENTOR(S) : Harold L. Adair

It is certified that error appears in the above-identified patent and that said Letters Patent is hereby corrected as shown below:

IN THE CLAIMS

In Claim 1 (column 4, line 38), please delete "postion" and substitute therefor --position--;

In Claim 1 (column 4), subsection (a), in both occurrences on lines 46 and 49, please delete "pivotally" and substitute therefor --pivotably--;

In Claim 4 (column 5, line 11), subsection (a), please delete "pivotally" and substitute therefor --pivotably--;

In Claim 4 (column 6, line 6), subsection (b), please delete "other" and substitute therefor --order--.

Signed and Sealed this

First Day of November, 1988

*Attest:*

*Attesting Officer*

DONALD J. QUIGG

*Commissioner of Patents and Trademarks*